US010207137B2

(12) United States Patent
Briggs et al.

(10) Patent No.: US 10,207,137 B2
(45) Date of Patent: Feb. 19, 2019

(54) CARRIAGE SYSTEM AND METHOD

(71) Applicant: Whitewater West Industries Ltd., Richmond (CA)

(72) Inventors: Rick Briggs, Springfield, IL (US); Mark Weston, Wakefield, RI (US); Hyuma Frankowski, Vancouver (CA); Greg MacDougall, Vancouver (CA); Daniel Brassard, Vancouver (CA); Peter Petkov, Port Coquitlam (CA)

(73) Assignee: WHITEWATER WEST INDUSTRIES LTD., Richmond, BC (CA)

( * ) Notice: Subject to any disclaimer, the term of this patent is extended or adjusted under 35 U.S.C. 154(b) by 170 days.

(21) Appl. No.: 14/920,100

(22) Filed: Oct. 22, 2015

(65) Prior Publication Data

US 2017/0043791 A1 Feb. 16, 2017

Related U.S. Application Data

(60) Provisional application No. 62/067,929, filed on Oct. 23, 2014.

(51) Int. Cl.
*A63B 9/00* (2006.01)
*A63G 31/00* (2006.01)
(Continued)

(52) U.S. Cl.
CPC ..... *A63B 9/00* (2013.01); *A63B 71/0054* (2013.01); *A63G 21/20* (2013.01); *A63G 31/00* (2013.01);
(Continued)

(58) Field of Classification Search
CPC ..... A63B 9/00; A63G 21/00; A63G 21/04; A63G 21/06; A63G 21/08; A63G 21/22; A63G 31/00
See application file for complete search history.

(56) References Cited

U.S. PATENT DOCUMENTS 5,443,012 A * 8/1995 Underbrink ..... A63G 21/20 104/118
5,820,471 A 10/1998 Briggs
(Continued)

FOREIGN PATENT DOCUMENTS

CA 2762545 11/2009

OTHER PUBLICATIONS www.spectrumsports.com; webpage showing Rope-A-Phobia; 2004.

*Primary Examiner* — Robert J McCarry, Jr.
(74) *Attorney, Agent, or Firm* — Buchalter PC

(57) ABSTRACT

Embodiments of the invention provide a safety system for coupling a rider to an amusement attraction with a track assembly including a junction box, and a plurality of control surfaces. The plurality of control surfaces includes slideable and rollable control surfaces. The safety system includes a carriage system for coupling the rider to the track assembly including a main support assembly, and a rolling safety mechanism including a rotatable element. The rotatable element includes a track engagement surface including rolling and sliding surfaces. In some embodiments, the rolling safety mechanism includes a plurality of pucks. Some embodiments include a rolling safety mechanism with a partially truncated ellipsoidal member rotatably mounted to a control support. In other embodiments, the rolling safety mechanism includes two partially truncated ellipsoidal members each positioned at substantially opposite ends of a support frame that includes at least one lanyard support.

20 Claims, 11 Drawing Sheets

(51) Int. Cl.

| | |
|---|---|
| ***A63G 21/20*** | (2006.01) |
| ***A63G 31/02*** | (2006.01) |
| ***A63B 71/00*** | (2006.01) |
| *A63B 27/00* | (2006.01) |
| *A63B 71/02* | (2006.01) |

(52) U.S. Cl.

CPC ..... *A63G 31/02* (2013.01); *A63B 27/00* (2013.01); *A63B 2009/004* (2013.01); *A63B 2071/025* (2013.01); *A63B 2208/0285* (2013.01)

(56) References Cited

U.S. PATENT DOCUMENTS

| | | | |
|---|---|---|---|
| 5,865,680 | A | 2/1999 | Briggs |
| 6,360,669 | B1 | 3/2002 | Albrich |
| 6,569,023 | B1 | 5/2003 | Briggs |
| 6,761,637 | B2 | 7/2004 | Weston et al. |
| 7,175,534 | B2 | 2/2007 | Liggett |
| 7,309,302 | B1 | 12/2007 | Phillips |
| 7,381,137 | B2 | 6/2008 | Steele et al. |
| 7,416,054 | B2 | 8/2008 | Liggett |
| 7,614,957 | B2 | 11/2009 | Lickle |
| 7,699,140 | B2 | 4/2010 | Beggrow |
| 7,785,207 | B2 | 8/2010 | Henry et al. |
| 7,819,066 | B2 | 10/2010 | Smith |
| 7,981,004 | B2 | 7/2011 | Liggett et al. |
| 8,016,686 | B2 | 9/2011 | Liggett et al. |
| 8,057,316 | B2 | 11/2011 | Legary et al. |
| 8,066,578 | B2 | 11/2011 | Liggett |
| 8,360,937 | B2 | 1/2013 | Liggett |
| 8,683,925 | B2 | 4/2014 | Liggett |
| 8,752,668 | B2 | 6/2014 | Liggett et al. |
| 8,807,044 | B2 | 8/2014 | Liggett et al. |
| 8,893,852 | B2 | 11/2014 | Liggett |
| 9,782,682 | B2 | 10/2017 | Frankowski et al. |
| 2006/0189453 | A1 | 8/2006 | Leblonde |
| 2009/0078148 | A1 | 3/2009 | Cylvick |
| 2010/0133040 | A1 | 12/2010 | London |
| 2012/0125221 | A1 | 5/2012 | Gustaffson |
| 2012/0217092 | A1 | 8/2012 | Jones |
| 2013/0327591 | A1 | 12/2013 | Galpin |
| 2015/0090148 | A1 | 4/2015 | Weston et al. |
| 2015/0135982 | A1 | 5/2015 | De Rubes |
| 2016/0272225 | A1 | 9/2016 | Liggett et al. |
| 2017/0036123 | A1 | 2/2017 | Liggett |
| 2017/0043268 | A1 | 2/2017 | Briggs |

* cited by examiner

FRONT

Y Travel mode:

Guide tabs ensure that Roller maintains appropriate orientation. Tabs prevent vertical rotation and subsequent misalignment in track

SIDE

X Travel mode:

Pipe (or similar) ensures that Roller maintains appropriate orientation

Bifurcation occurs by means of carriage "skipping" across gaps, being guided by the force exerted by lanyard.

CARRIAGE SYSTEM AND METHOD

CROSS REFERENCE TO RELATED APPLICATIONS

This application claims the benefit of U.S. Provisional Patent Application Ser. No. 62/067,929, filed on Oct. 23, 2014, entitled "CARRIAGE SYSTEM AND METHOD," which is hereby incorporated by reference in its entirety.

FIELD OF THE INVENTION

The present invention relates to amusement attractions. More particularly, the present invention relates to carriage systems for challenge or rope courses with a safety system that permits continuous travel by the user along varying pathways without requiring the user to unhook from the safety system.

BACKGROUND

Ropes courses or other challenge or obstacles courses are a popular entertainment activity for both children and adults. Part of the thrill in traversing many of these courses is the high elevation above the ground that a user travels over, for example, by stepping across along pillars, columns, rope bridges, or the like. In order to increase user safety against falling from such heights and potentially being injured, safety systems have been developed that are worn or otherwise fasten with the user traversing the course that prevents the user from dropping to the ground. For example, many safety systems have taken the form of belts or vests worn by the user that are configured to clamp or fasten with a rope or other securing element to a part of the attraction at one end and to the user at the other end. Thus, even if a user loses their balance or footing while traversing the course, the safety system will keep the user from falling beyond a certain distance, for example, by dangling the user in the air and allowing the user an opportunity to regain their footing.

Unfortunately, traditional ropes courses or other challenge or obstacles courses require the user to traverse only along a linear pathway, without deviation, along the course due to the safety system constraints typically being fastened and movable only along such travel path. The level of excitement of the course may be reduced since freedom to move about the course as may be desired by users is prohibited. Many courses that do allow a user the freedom to choose a travel pathway also require the user to stop their movement on the course at a safe area or position, unhook from the safety system that is connected along the first pathway, and then rehook to the safety system that extends along the desired second pathway. Not only does such a system slow down the number of users that may use the course, but also is inconvenient for users who do not wish to have their play interrupted. Thus, a safety or belay system is desired that would allow users the freedom to traverse ropes, challenges, or other obstacle courses along a variety of user-chosen pathways without the inconvenience of unhooking and/or rehooking to the safety or belay system. Such a system would ideally provide a safe means of preventing injury to users, be reliable in operation and low in manufacturing expense while avoiding the above-mentioned deficiencies of conventional safety systems.

SUMMARY

Some embodiments of the invention include a safety system for coupling a rider to an amusement attraction comprising a track assembly including at least one junction box, and a plurality of control surfaces configured to transport the rider. The plurality of control surfaces includes at least one slideable control surface, and at least one rollable control surface. The safety system also comprises a carriage system for coupling the rider to the track assembly comprising a main support assembly configured to couple with the user and a track, and a rolling safety mechanism including at least one main shaft coupled to the main support assembly, and at least one rotatable element. The at least one rotatable element includes at least one track engagement surface for coupling to at least one of the plurality of control surfaces, and the at least one track engagement surface comprises at least one rolling surface and at least one sliding surface.

In some embodiments, the rolling safety mechanism is configured to roll within the track assembly when the at least one rolling surface rotatably couples with the at least one rollable control surface. In some further embodiments, the rolling safety mechanism is configured to slide within the track assembly when the at least one sliding surface slidably couples to the at least one slideable control surface. In some other embodiments, the rolling safety mechanism can move on the track assembly by substantially simultaneously sliding when the at least one sliding surface slidably engages the at least one slideable control surface and rolling when the at least one rolling surface rotatably engages the at least one rollable control surface.

Some embodiments of the invention include a rolling safety mechanism that includes a plurality of pucks comprising the at least one rolling surface and the at least one sliding surface. Some further embodiments of the invention include a rolling safety mechanism that comprises at least one partially truncated ellipsoidal member rotatably mounted to a control support.

In some embodiments, the track assembly further comprises guide tabs configured to couple with at least a portion of the rolling safety mechanism to prevent vertical rotation and misalignment in the track assembly. In some embodiments, the track assembly further comprises at least one pipe segment configured to enclose and orientate the rolling safety mechanism.

In some further embodiments of the invention, the rolling safety mechanism comprises at least two partially truncated ellipsoidal members each positioned at substantially opposite ends of a support frame. The support frame includes at least one lanyard support extending from the support frame. In some embodiments, the lanyard support is configured to enable a coupled lanyard to guide the rolling safety mechanism by substantially freely moving on the lanyard support.

DETAILED DESCRIPTION

Figure 1:
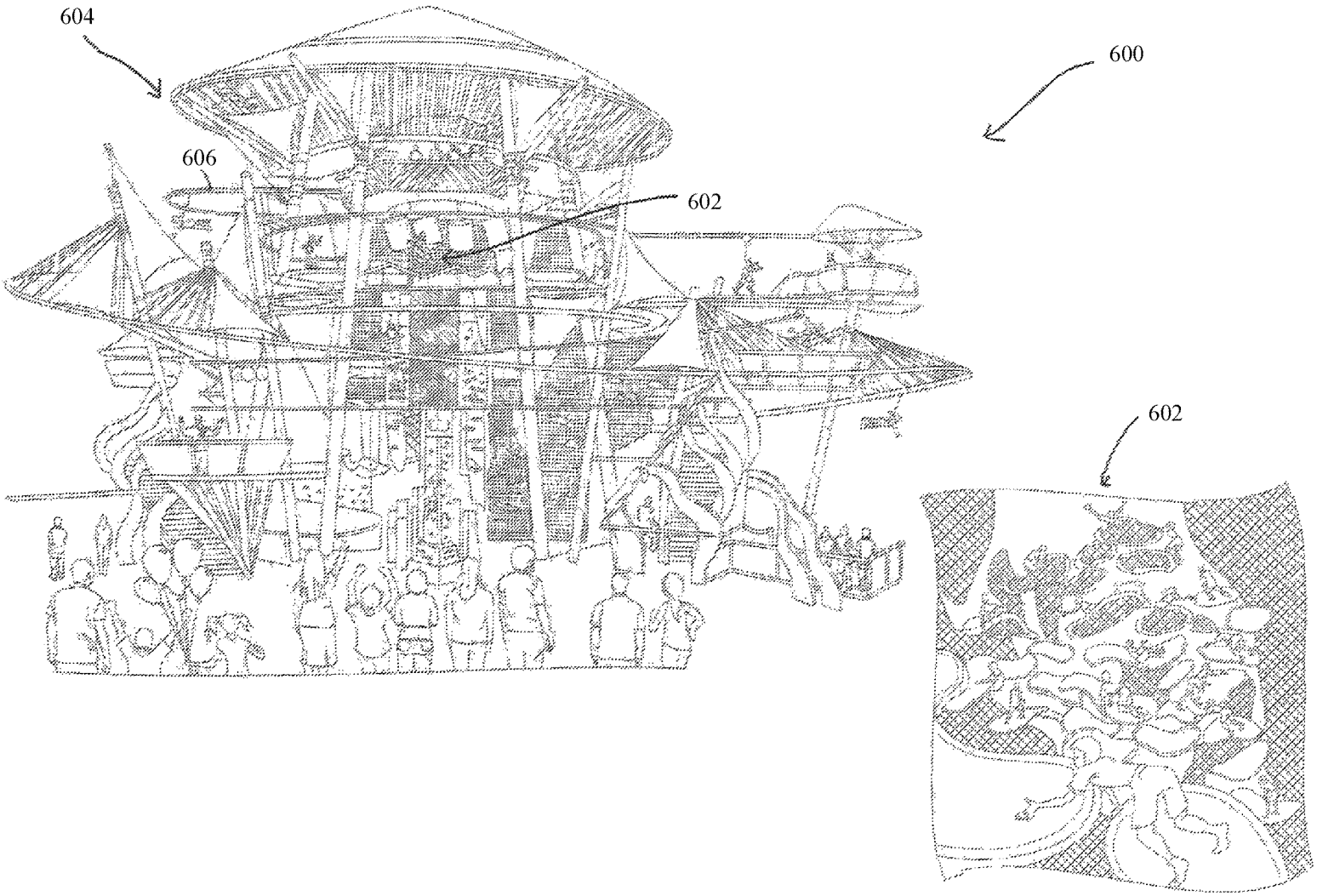
FIG. 1 shows a plurality of views of an amusement attraction including a harnessed section incorporating a zipline and utilizing a continuous safety or belay system according to one embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention. Moreover, any of the functions or steps may be outsourced to or performed by one or more third parties. Furthermore, any reference to singular includes plural embodiments, and any reference to more than one component may include a singular embodiment.

Figure 2:
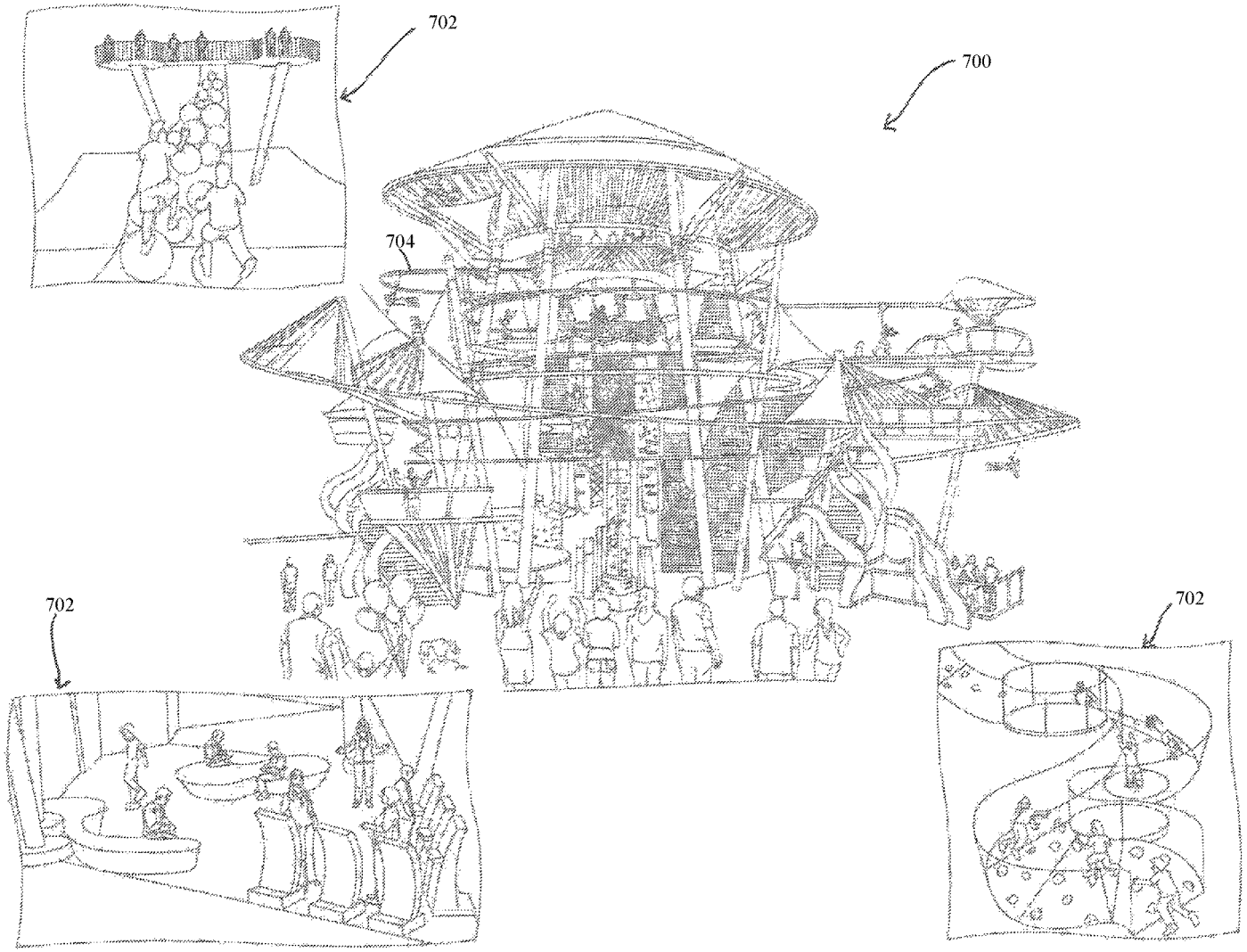
FIG. 2 shows a plurality of views of an amusement attraction including a harnessed section and utilizing a continuous safety or belay system according to one embodiment of the present invention.

FIG. 1 shows a plurality of views of an amusement attraction 600 including a harnessed section 602 utilizing a continuous safety or belay system, which allows a user to slide along a zipline located at an elevation above a floor or lower surface of the amusement attraction 600. The user travels along the zipline from one portion of the amusement attraction 600 to another portion (e.g., at a fast rate of speed). In the harnessed section 602, users are coupled (e.g., via a rope and/or track coupling element) 604 to the amusement attraction 600 for safety purposes. The continuous safety or belay system may allow users to traverse among multiple pathways, at the users' discretion, without requiring the users to unhook and/or rehook to the safety or belay system. Although FIG. 1 illustrates one potential setup or design for the amusement attraction 600 that includes the harnessed section 602; in an alternative embodiment, any of a variety of possible setups or designs may be used. For example, FIG. 2 shows a plurality of views of an amusement attraction 700 including a harnessed section 702 utilizing a continuous safety or belay system, as discussed in greater detail herein, which allows a user to climb, slide, or otherwise interact with a variety of differing features or activities of the amusement attraction 700. In the harnessed section 702, users are coupled (e.g., via a rope and/or track coupling element) to the amusement attraction 700 for safety purposes. As discussed in greater detail herein, the continuous safety or belay system may allow users to traverse among multiple pathways, at the users' discretion, without requiring the users to unhook and/or rehook to the safety or belay system. Although FIG. 2 illustrates one potential setup or design for the amusement attraction 700 that includes the harnessed section 702, in an alternative embodiment, any of a variety of possible setups or designs may be used. In certain embodiments, leaping, traversing, ziplines, etc., may be incorporated into any of a variety of designs for a desired amusement attraction. By utilizing a continuous safety or belay system, a user may participate in any and/or all of the features or activities of a given amusement attraction without needing to disconnect or reconnect to the safety or belay system. Thus, users are provided additional freedom to safely traverse an amusement attraction as they desire without being inconvenienced by the design of the safety systems during their traversal of the ride.

Figure 3A:
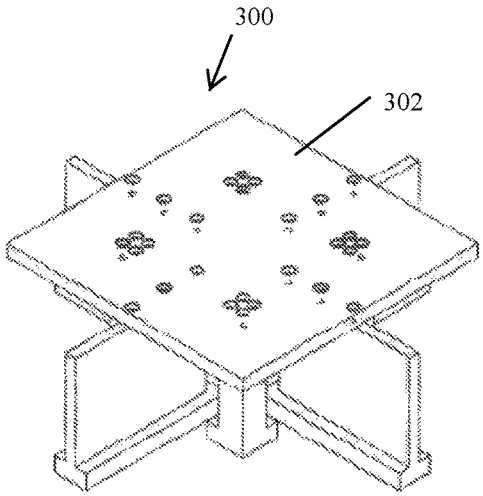
FIG. 3A illustrates a perspective view of a track assembly including a junction box capable of guiding a rolling safety mechanism for an amusement attraction according to one embodiment of the present invention.
Figure 3B:
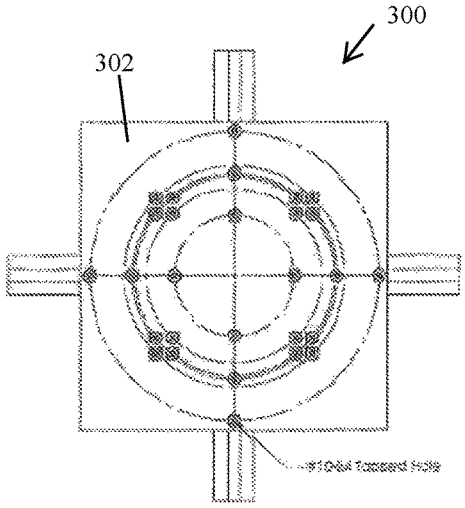
FIG. 3B illustrates a top view of a track assembly capable of guiding a rolling safety mechanism for an amusement attraction according to one embodiment of the present invention.

Some embodiments of the invention can include various track systems and components to enable a user to travel in one or more directions within an amusement attraction (such as the aforementioned amusement attractions 600, 700), Further, in some embodiments, various components and assemblies can a user to move in one direction, and then switch to another direction within the track system. In some embodiments, one or more components of the track system can operate in various modes depending on the direction of travel and/or the speed of the rider. For example, in some embodiments, the various track systems and components can include at least one junction box coupled to at least one track segment. FIG. 3A, for example, illustrates a perspective view of a track assembly 300 including a junction box 302 capable of guiding a rolling safety mechanism for an amusement attraction according to one embodiment of the present invention. FIG. 3B illustrates a top view of the track assembly junction box 302 shown in FIG. 3A. In this example, the junction box 302 includes a body, and a track mount coupled to the body and to a top support. Shown extending from the junction box are track segments comprising a first track segment, and a second track segment positioned substantially perpendicular to the first track segment. In some embodiments, the junction box 302 can comprise various motion support surfaces capable of supporting motion of a safety mechanism. For example, in some embodiments, the first and second track segments can comprise a lower sliding surface portion, and at least one upper rolling surface extending from the lower sliding surface portion.

In some embodiments, the at least one upper rolling surface and the lower sliding surface portion of the first track segment can enable movement of a rolling safety mechanism 400 in one (forward) direction and a reverse direction. Further, in some embodiments, the at least one upper rolling surface and the lower sliding surface portion of the second track segment can enable movement of a rolling safety mechanism 400 in one (forward) direction and a reverse direction. In some further embodiments, the direction (either in a forward or reverse direction) on the first track segment can be substantially perpendicular to the direction (either in a forward or reverse direction) on the second track segment.

Figure 4A:
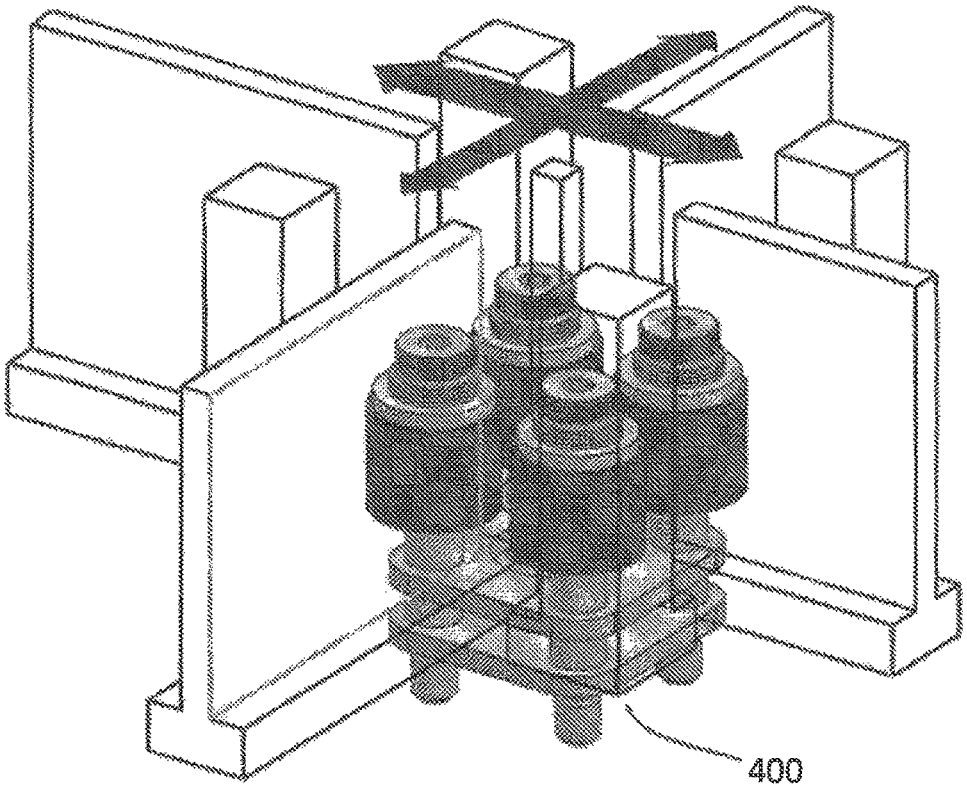
FIG. 4A illustrates a perspective view of a track assembly with a coupled rolling safety mechanism for an amusement attraction according to one embodiment of the present invention.

For example, FIG. 4A illustrates a perspective view of a track assembly with a coupled rolling safety mechanism 400 for an amusement attraction according to one embodiment of the present invention. As shown, in some embodiments, the rolling safety mechanism 400 can comprise a four puck configuration positioned substantially centrally within the junction box. In this illustrative example, each of the first track segments and the second track segments can be positioned to pass between the four puck rollers to move in a desired direction (e.g., in either of the directions shown by the arrows).

Figure 4B:
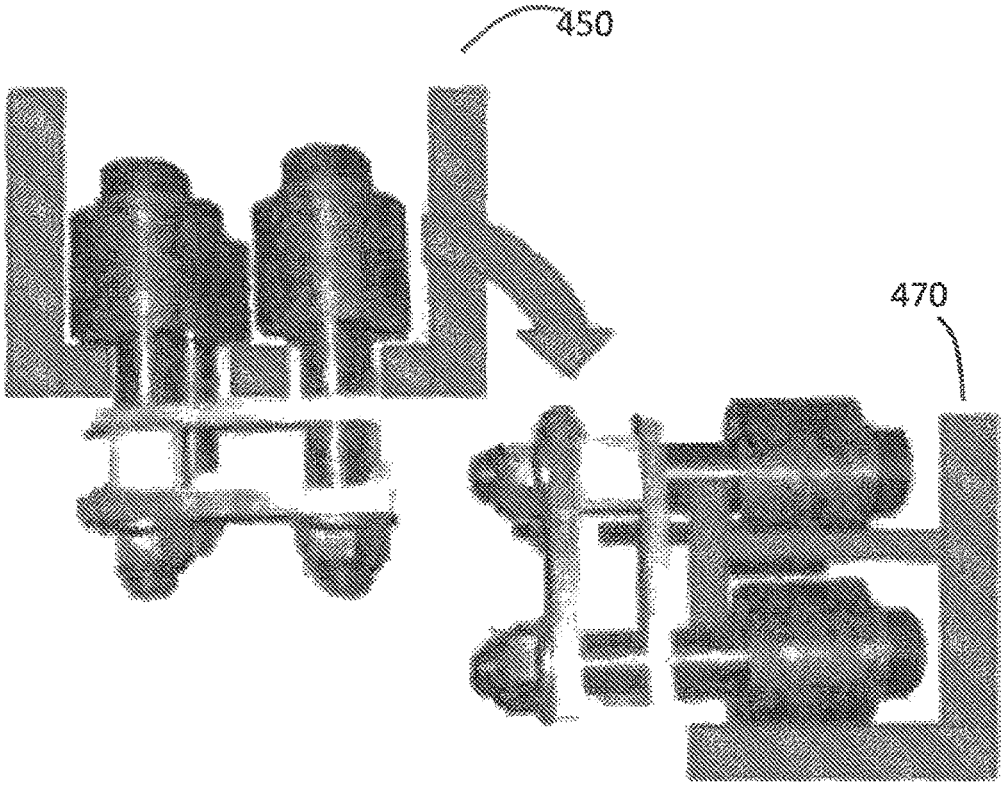
FIG. 4B illustrates a representation switchable orientations of a track assembly with a coupled rolling safety mechanism for an amusement attraction according to one embodiment of the present invention.

In some embodiments, the rolling safety mechanism 400 can be configured to move within the junction box differently depending on its orientation when positioned and coupled with the junction box. For example, FIG. 4B illustrates a representation of switchable orientations 450, 470 of a track assembly including a junction box with a coupled rolling safety mechanism 400 for an amusement attraction according to one embodiment of the present invention. In some embodiments, when the track assembly including the junction box and coupled rolling safety mechanism 400 is in a vertical position (orientation 450), the four pucks of the rolling safety mechanism 400 can move by sliding. In this instance, the four pucks can slide within the junction box at least by sliding on one or more lower sliding surface portions. In some embodiments, the rolling safety mechanism 400 can switch from a sliding to a rolling action of motion. For example, as illustrated by the orientation 470 in FIG. 4B, in some embodiments, when the junction box and coupled rolling safety mechanism 400 are positioned on its side, and rotated approximately 90° from the orientation 450, the one or more of the pucks of the rolling safety mechanism 400 can be coupled to at least one of the upper rolling surfaces. In this configuration, the rolling safety mechanism 400 can move in a horizontal axis by rolling on one or more of the upper rolling surfaces. In some other embodiments, the rolling safety mechanism 400 can move in the junction box at least partially by a sliding action, and at least partially by a rolling action. For example, in some embodiments, the junction box can be positioned at an angle between the vertical and horizontal axis, and the rolling safety mechanism 400 can move within the junction box either by sliding on at least one lower sliding surface, and rolling on at least one upper rolling surface.

In some embodiments, the track assembly of FIG. 4B including a four puck rolling safety mechanism 400 coupled to a junction box including a switchable movement action can be configured to cooperate and roll along a track (e.g., such as any track depicted in the amusement attractions 600, 700). Further, in some embodiments, by enabling the rolling safety mechanism 400 to switch from a sliding to a rolling movement action, a coupled rider can move at a higher speed within a specified safety range. For example, in some embodiments, the rolling safety mechanism 400 can travel down the track with a user coupled to the rolling safety mechanism 400. In some embodiments, the user can be connected to the rolling safety mechanism 400 by any of a variety of connection means, such as a lanyard, or any of a variety of other connecting components (e.g., standardized and conventional off-the-shelf components, and/or a variety of other specific or specialized connecting components). In some further embodiments, the rolling safety mechanism 400 can support at least one vehicle for transporting a rider e.g., such as a roller coaster, or other conventional amusement park riding assembly).

Figure 5A:
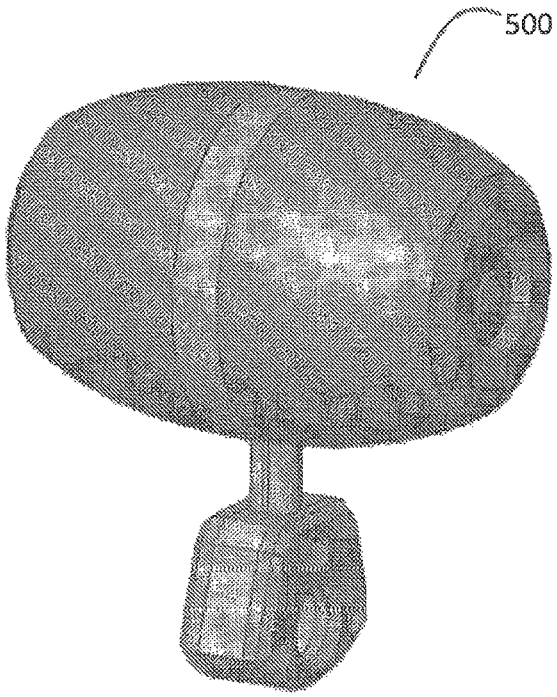
FIG. 5A illustrates a perspective view of a rolling safety mechanism for an amusement attraction according to one embodiment of the present invention.
Figure 5B:
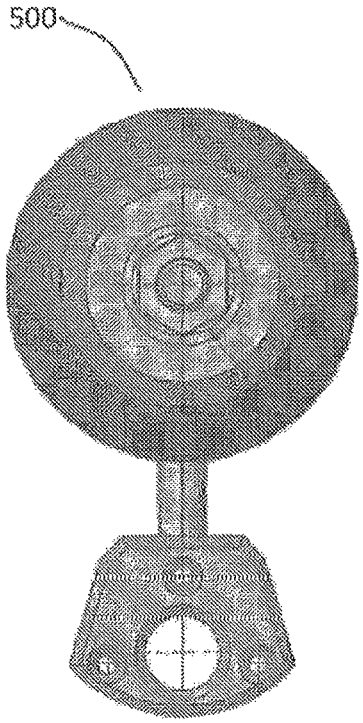
FIG. 5B illustrates a side view of a rolling safety mechanism for an amusement attraction according to one embodiment of the present invention.

FIG. 5A illustrates a perspective view of a rolling safety mechanism 500 for an amusement attraction, and FIG. 5B illustrates a side view of a rolling safety mechanism 500 for an amusement attraction according to one embodiment of the present invention. In some embodiments, the rolling safety mechanism 500 can incorporate one or more rollers that are configured to rotate or roll along a track (e.g., such as any track illustrated in FIGS. 1 and 2). In some embodiments, the rolling safety mechanism 500 can include an anchor ring defining an opening therein for a user to connect to the rolling safety mechanism via a rope, lanyard, etc.

Figure 5C:
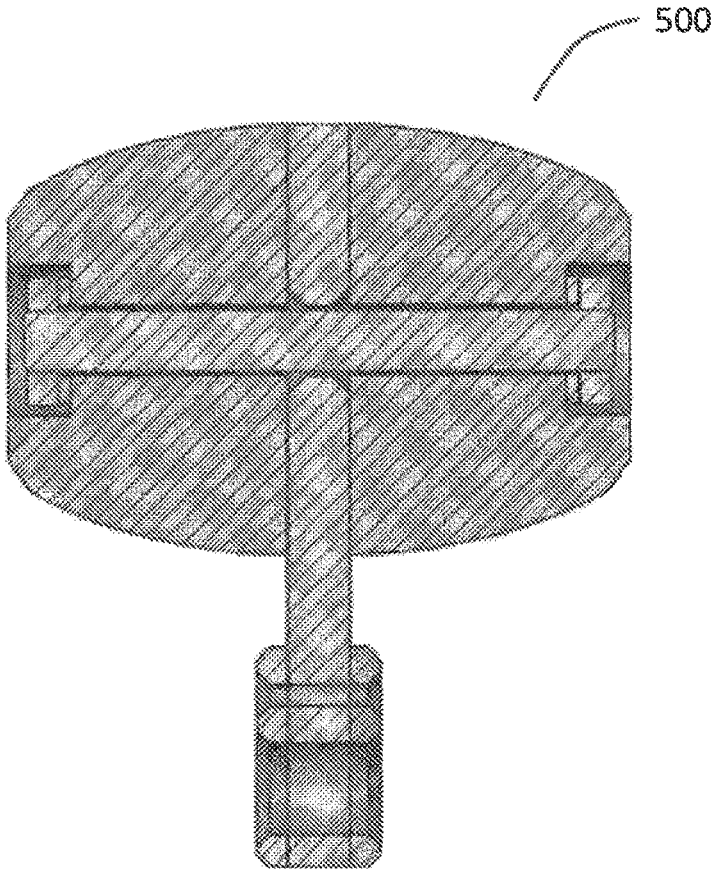
FIG. 5C illustrates a cross-sectional view of a rolling safety mechanism for an amusement attraction according to one embodiment of the present invention.

As illustrated in FIG. 5C illustrating a cross-sectional view of a rolling safety mechanism 500 for an amusement attraction, in some embodiments, the rolling safety mechanism 500 can comprise a central support rod coupled to at least one bearing assembly. In some embodiments, rollers comprising at least partially truncated ellipsoidal members can rotate on the central support rod to support movement of the rolling safety mechanism 500 when coupled to at least one track assembly. Further, in some embodiments, the aforementioned anchor ring can be coupled to a connecting swing rod that extends to a central support ring coupled to rollers providing a rolling surface.

Figures 6A, 6B, 6C, 6D, 6E, 6F:
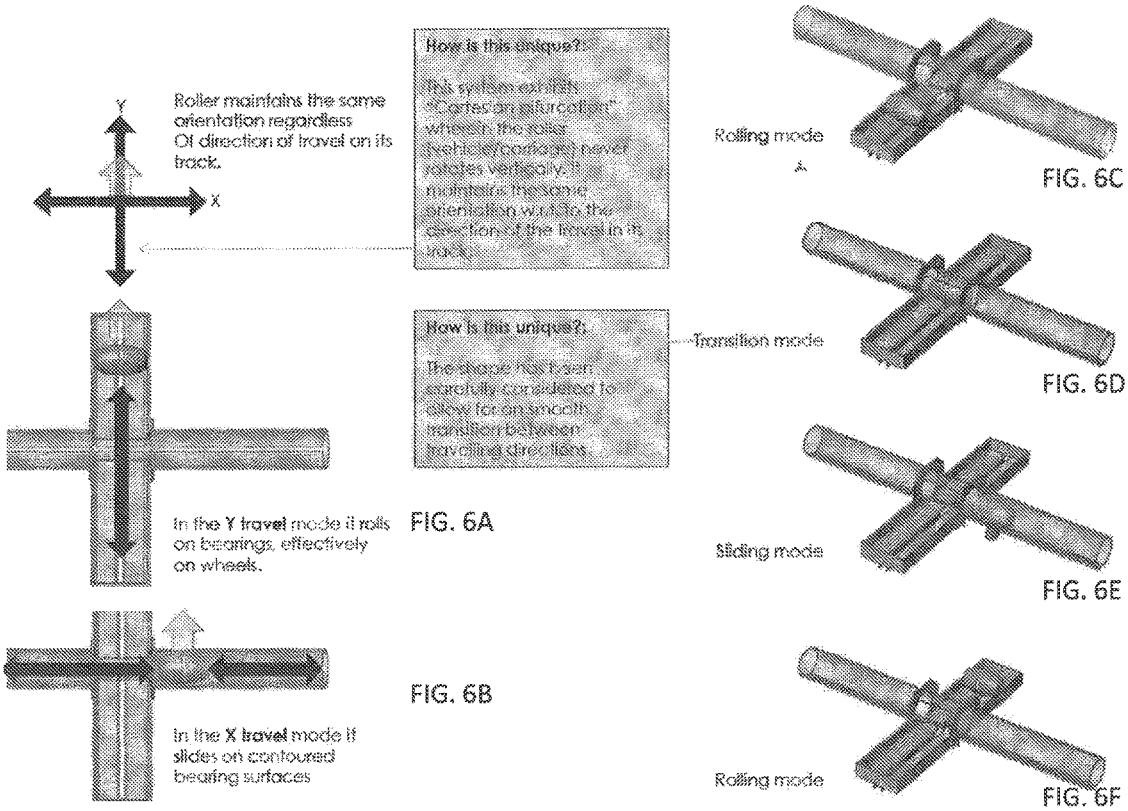
FIGS. 6A-F illustrates various views of various operational rolling modes of the rolling safety mechanism of FIG. 5A for an amusement attraction according to one embodiment of the present invention.

In some embodiments, the rolling safety mechanism 500 can travel down a track with a user coupled to the rolling safety mechanism 500. In some further embodiments, the rolling safety mechanism 500 can support at least one rider (e.g., by any of a variety of connection means, such as a lanyard, or any of a variety of other connecting components) or vehicle for transporting a rider (e.g., such as a roller coaster, or other conventional amusement park riding assembly). In some embodiments, the rolling safety mechanism 500 can move within a specialized track system capable of enabling movement of the rolling safety mechanism 500 in a variety of directions using a variety of movement actions. For example, FIGS. 6A-F illustrate various views of various operational rolling modes of the rolling safety mechanism of FIG. 5A for an amusement attraction according to one embodiment of the present invention. Referring initially to FIG. 6A, in some embodiments, a track system can comprise various portions and segments including at least one rolling section coupled to at least one sliding section. As illustrated, in some embodiments, the rolling safety mechanism 500 can move within the rolling section in a y-axis direction by rolling on bearings (i.e., by rolling about the central support rod coupled to at least one bearing assembly). As depicted by the arrows, the rolling safety mechanism 500 can move in either direction along the y-axis by rolling on the bearings. In some further embodiments, the rolling safety mechanism 500 can move into another portion or segment of a track system comprising a sliding surface. As illustrated in FIG. 6B, in some embodiments, the rolling safety mechanism 500 can traverse a portion of a track system in an x-axis direction by traveling on contoured bearing surfaces within the sliding surface portion or segment of the track system.

The directional movement and transition to and from a rolling to sliding action portion or segment of the track system can best be illustrated in FIGS. 6C-6F. For example, FIG. 6C illustrates a rolling safety mechanism 500 rolling towards a transition region of the track system. In this example, the rolling safety mechanism 500 is moving in a rolling mode on the track system as described for FIG. 6A, FIG. 6D shows the rolling safety mechanism 500 has reached a transition region of the track system. While in this position, an amusement system operator and/or one or more riders can control the rolling safety mechanism 500 to allow the rolling safety mechanism 500 to move in an alternate direction. For example, as illustrated in FIG. 6E, in some embodiments, the rolling safety mechanism 500 can move into a portion or segment of the track system by transitioning to a sliding movement action as described earlier with respect to FIG. 6B. Alternatively, in some embodiments, after exiting the transition region shown in FIG. 6D, the rolling safety mechanism 500 can continue to travel in the rolling mode on the track system. Further, in some embodiments, the rolling safety mechanism 500 can reverse direction and travel back onto the rolling portion or segment after reentering the transition region.

Figure 7A:
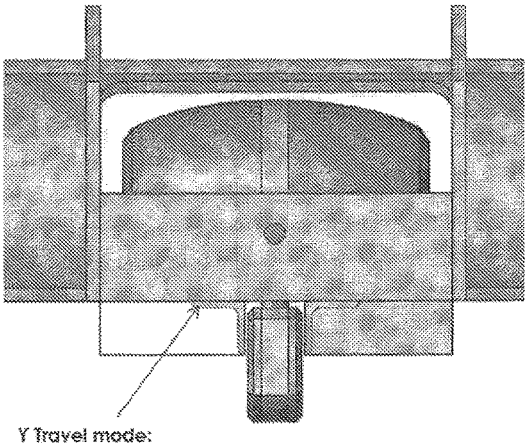
FIG. 7A illustrates a front view of the rolling safety mechanism of FIG. 5A within a track assembly for an amusement attraction according to one embodiment of the present invention.

Some embodiments of the track system illustrated in FIGS. 6A-6F can include one or more components to guide the rolling safety mechanism 500. For example FIG. 7A illustrates a front view of the rolling safety mechanism 500 of FIG. 5A within a track assembly for an amusement attraction, wherein a track engagement surface 702 of the rolling safety mechanism is contacting a track assembly, according to one embodiment of the present invention. As shown in FIG. 7A, when the rolling safety mechanism 500 is travelling within a track system that can comprise various portions and segments including at least one rolling section coupled to at least one sliding section, the rolling safety mechanism 500 can move within the rolling section by rolling on bearings (as described earlier with respect to FIG. 6A). In some embodiments, guide tabs can be coupled to a region of the track system to assist in guiding the rolling safety mechanism 500 as it is travelling within the track system. For example, in some embodiments, at least a portion of the anchor ring and/or connecting swing rod can be positioned adjacent to and/or coupled to at least one of the guide tabs.

Figure 7B:
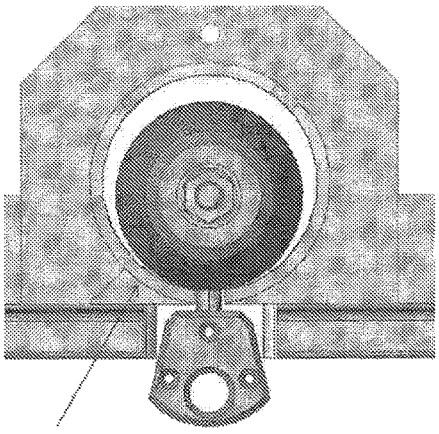
FIG. 7B illustrates a side view of the rolling safety mechanism of FIG. 5A within a track assembly for an amusement attraction according to one embodiment of the present invention.

Some embodiments of the track system illustrated in FIGS. 6A-6F can include one or more components to assist in maintaining an orientation of the rolling safety mechanism 500. For example, FIG. 7B illustrates a side view of the rolling safety mechanism of FIG. 5A within a track assembly for an amusement attraction according to one embodiment of the present invention. As shown, when the rolling safety mechanism 500 is travelling within a track system that can comprise various portions and segments including at least one sliding section coupled to at least one rolling section, the rolling safety mechanism 500 can move within the sliding section by rolling on contoured bearing surfaces (as described earlier with respect to FIG. 6B). In some embodiments, the orientation of the rolling safety mechanism 500 while traveling in the sliding section can be maintained using a pipe structure. In some embodiments, the pipe structure can at least partially enclose the rolling safety mechanism 500. In some embodiments, a channel or other aperture can be positioned at the base of the pipe structure to allow the connecting swing rod and anchor to be positioned through the base of the pipe structure. Further, in some embodiments, a lower guide channel can be configured to enable at least a portion of the anchor ring and/or connecting swing rod to be positioned adjacent to and/or coupled to the guide channel while the rolling safety mechanism 500 is traveling in the track system.

Figure 8B:
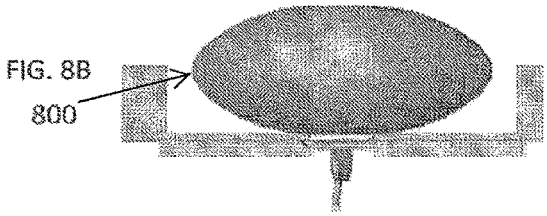
FIG. 8B illustrates a front view of a carriage system 800 coupled to a track system for an amusement attraction according to one embodiment of the present invention.
Figure 8A:
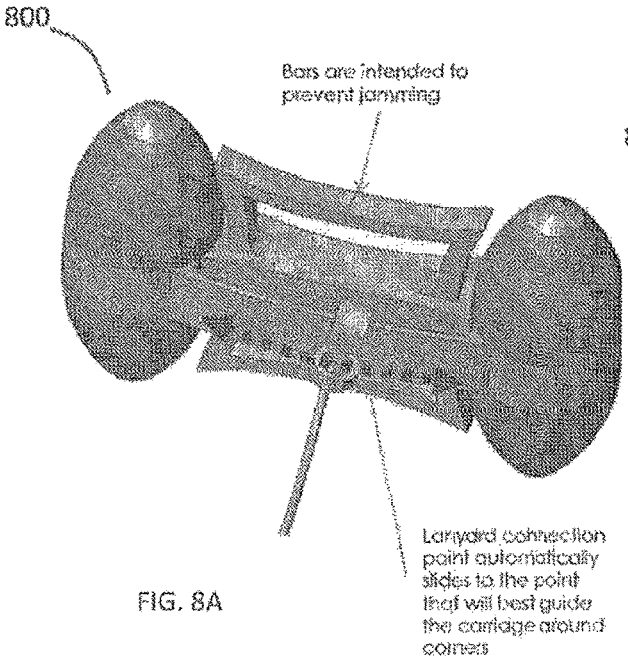
FIG. 8A illustrates a perspective view of a carriage system 800 for an amusement attraction according to one embodiment of the present invention.

In some embodiments, various rolling safety mechanisms can include a various structural support assemblies. For example, in some embodiments, various rolling safety mechanisms can include a carriage assembly system. For example, FIG. 8A illustrates a perspective view of a carriage system 800 for an amusement attraction according to one embodiment of the present invention. In some embodiments, the carriage system 800 can comprise a support frame with two partially truncated ellipsoidal members each positioned at each end of the support frame. In some embodiments, the support frame can comprise at least one lanyard support or connection point, and at least one anti-jamming frame extending from the support frame. In some embodiments, the at least one lanyard support can extend from each end of the support frame.

In some embodiments, the at least one lanyard support can include a curved section extending from each end of the support frame. In some embodiments, a lanyard can be slidably coupled to the at least one lanyard support. Further, in some embodiments, the lanyard can be slidably moved along the at least one lanyard support in the directions shown by the arrows. In some embodiments, an amusement ride operator and/or a rider can move the lanyard to a position on the lanyard support to move the carriage system 800 in a desired direction.

Figure 8C:
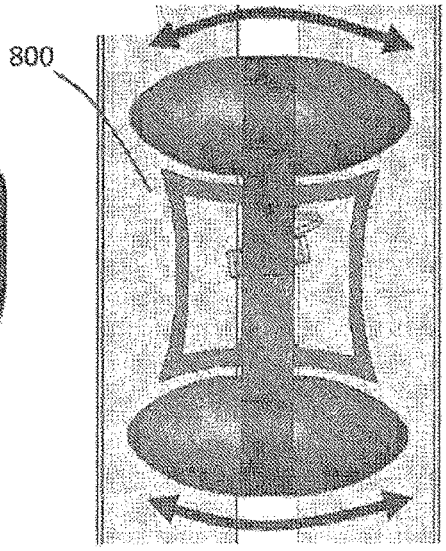
FIG. 8C illustrates a top view of a carriage system 800 coupled to a track system for an amusement attraction according to one embodiment of the present invention.

In some embodiments, the carriage system 800 can be coupled to a track system. In some embodiments, the carriage system 800 can travel down a track with a user coupled to the carriage system 800. In some embodiments, the user can be connected to the carriage system 800 by any of a variety of connection means, such as a lanyard, or any of a variety of other connecting components (e.g., standardized and conventional off-the-shelf components, and/or a variety of other specific or specialized connecting components). In some further embodiments, the carriage system 800 can support at least one vehicle for transporting a rider (e.g., such as a roller coaster, or other conventional amusement park riding assembly). For example, FIG. 8B illustrates a front view of a carriage system 800 coupled to a track system for an amusement attraction, and FIG. 8C illustrates a top view of a carriage system 800 coupled to a track system for an amusement attraction according to one embodiment of the present invention. As illustrated in FIG. 8B, in some embodiments, the track can include a channel or aperture through which a coupled lanyard can be passed to enable travel clearance for the lanyard as the carriage system 800 moves along the track. The channel or aperture is further shown in FIG. 8C, which shows the carriage system 800 substantially centrally positioned on the track, and configured to be moved along the track. Further, as depicted by the directional arrows, in some embodiments, the carriage system 800 can be swiveled on the track in one more directions.

FIGS. 8A and 8C also depict a coupled anti-jamming frame with at least one bar extension that in some embodiments can comprise one or more bars extending from the support frame by one or more coupled support members. In some embodiments, at least a portion of the anti-jamming frame can include a portion that is shaped to substantially follow the shape of the truncated ellipsoidal members coupled at each end of the support frame. Further, in some embodiments, the at least one bar extension can include one or more bars that are inwardly curved towards the support frame.

Figure 9A:
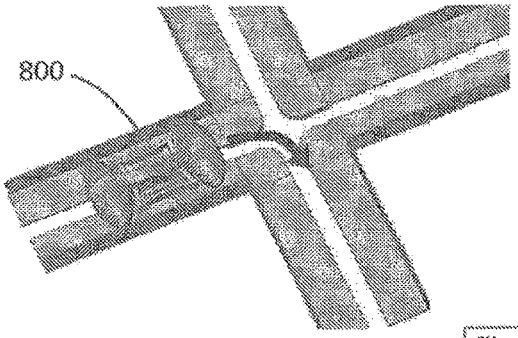
FIG. 9A illustrates a perspective view of a representation of travel of the rolling safety mechanism of FIG. 8A on a track assembly for an amusement attraction according to one embodiment of the present invention.

In some embodiments, the carriage system 800 can be coupled to a track system comprising a track assembly comprising at two or more track segments. For example, FIG. 9A illustrates a perspective view of a representation of travel of the carriage system 800 of FIG. 8A on a track assembly for an amusement attraction according to one embodiment of the present invention. As depicted by the arrow in FIG. 8A, in some embodiments, the carriage system 800 can be controlled by an operator and/or a rider to move from one track portion or segment to another track portion or segment. Further, in some embodiments, the carriage system 800 can be controlled by an operator and/or a rider to change directions on a track system by moving from one track portion or segment to another track portion or segment.

Figure 9C:
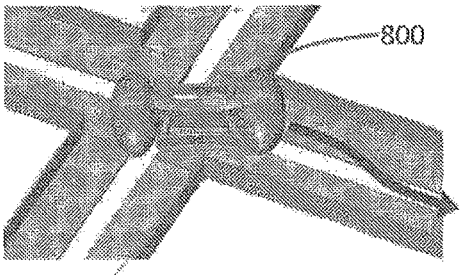
FIG. 9C illustrates a perspective view of a representation of travel of the rolling safety mechanism of FIG. 8A on a track assembly for an amusement attraction according to one embodiment of the present invention.
Figure 9B:
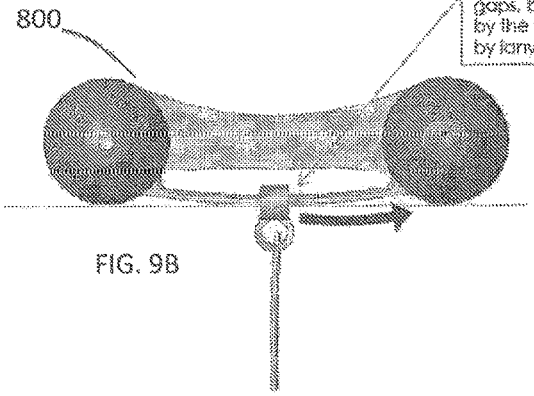
FIG. 9B illustrates side view of the rolling safety mechanism of FIG. 8A on a track assembly represented in FIG. 9A showing a lanyard position for an amusement attraction according to one embodiment of the present invention.
Figure 9D:
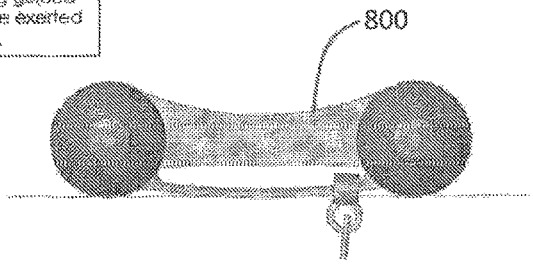
FIG. 9D illustrates side view of the rolling safety mechanism of FIG. 8A on a track assembly represented in FIG. 9B showing a lanyard position for an amusement attraction according to one embodiment of the present invention.

In some embodiments, in order to move a carriage system 800 from one track for traveling in one direction to another track for traveling in another direction (e.g., to turn 90°), the carriage system 800 can be moved so that it swivels on the track in one more directions. FIG. 9B illustrates side view of the carriage system 800 of FIG. 8A on a track assembly represented in FIG. 9A showing a lanyard position for an amusement attraction according to one embodiment of the present invention. In some embodiments, by moving the lanyard in the direction shown by the arrow, the lanyard can move on the lanyard support to the turn position shown in FIG. 9A. In this instance, travel bifurcation can occur by the carriage system 800 "skipping" across gaps in the track system, guided by the force exerted by the lanyard. For example, FIG. 9D illustrates side view of the carriage system 800 of FIG. 8A on a track assembly represented in FIG. 9B showing a lanyard position for an amusement attraction according to one embodiment of the present invention. The lanyard is shown positioned on the lanyard support at one end (the forward end of travel of the carriage system 800), and FIG. 9C illustrates a perspective view of a representation of travel of the carriage system 800 of FIG. 8A on a track assembly for an amusement attraction according to one embodiment of the present invention. In some other embodiments, the carriage system 800 can be directed in other directions or orientations than those depicted by swiveling the carriage system 800 using the methods as described earlier.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

The invention claimed is:

1. A safety system for coupling a rider to an amusement attraction comprising:

a track assembly including at least one junction box and a plurality of control surfaces, the plurality of control surfaces including a slideable control surface configured to permit slideable movement along the slideable control surface and a rollable control surface configured to permit rollable movement along the rollable control surface;

a carriage system for coupling the rider to the track assembly comprising:

a harness section configured to couple to a user, a safety mechanism configured to couple the harness section to the track assembly, the safety mechanism having:

a first track engagement surface configured to slide along the slideable control surface in a first direction when the first track engagement surface is engaged with the slideable control surface, and a second track engagement surface configured to roll along the rollable control surface in a second direction different from a first direction when the second track engagement surface is engaged with the rollable control surface.

2. The continuous safety system of claim 1, wherein the safety mechanism is configured to roll within the track assembly when the second track engagement surface rotatably couples with the rollable control surface.

3. The continuous safety system of claim 1, wherein the safety mechanism is configured to slide within the track assembly when the first track engagement surface slidably couples to the at least one slideable control surface.

4. The continuous safety system of claim 1, wherein the safety mechanism can move on the track assembly by substantially simultaneously sliding when the first track engagement surface slidably engages the slideable control surface and rolling when the second track engagement surface rotatably engages the rollable control surface.

5. The continuous safety system of claim 1, wherein the safety mechanism includes a plurality of pucks, the plurality of pucks comprising the first track engagement surface and the second track engagement surface.

6. The continuous safety system of claim 1, wherein the safety mechanism comprises at least one partially truncated ellipsoidal member rotatably mounted to a control support.

7. The continuous safety system of claim 1, wherein the track assembly further comprises guide tabs configured to couple with at least a portion of the safety mechanism to prevent vertical rotation of the safety mechanism relative to the track assembly and misalignment in the track assembly.

8. The continuous safety system of claim 1, wherein the track assembly further comprises at least one pipe segment configured to orient and enclose at least a portion of the safety mechanism.

9. The continuous safety system of claim 1, wherein the safety mechanism comprises at least two partially truncated ellipsoidal members each positioned at substantially opposite ends of a support frame, the support frame including at least one lanyard support extending from the support frame.

10. The continuous safety system of claim 9, wherein the lanyard support is configured to enable a coupled lanyard to guide the safety mechanism by substantially freely moving on the lanyard support.

11. The continuous safety system of claim 1, wherein the first direction is angled relative to the second direction.

12. The continuous safety system of claim 11, wherein the carriage assembly is configured to mate with the track assembly and permit motion of the safety mechanism in the first direction relative to the track assembly when the slideable control surface is engaged with the first track engagement surface and the second track engagement surface is out of contact with the rollable control surface, and is configured to mate with the track assembly and permit motion of the safety mechanism in the second direction relative to the track assembly when the rollable control surface is engaged with the second track engagement surface and the first track engagement surface is out of contact with the slideable control surface.

13. The continuous safety system of claim 12, wherein the safety mechanism is in a first orientation when configured to move in the first direction and is in a second orientation when configured to move in the second direction, and the first orientation is rotated relative to the second orientation.

14. The continuous safety system of claim 11, wherein the safety mechanism comprises a rolling element and an aperture element, the slideable control surface includes a shaft for sliding along the aperture element and the rollable control surface includes a planar surface for rolling the rolling element.

15. The continuous safety system of claim 14, wherein the aperture element extends below the rolling element and an axis of the aperture is parallel to an axis of rotation of the rolling element.

16. The continuous safety system of claim 15, wherein the track assembly comprises a tab configured to abut the aperture element and maintain a desired position of the rolling element relative to the rollable control surface.

17. The continuous safety system of claim 11, wherein the safety mechanism comprises a rolling element and a planar element, the slideable control surface includes a first planar surface for sliding on the planar element and a second planar surface for rolling the rolling element.

18. The continuous safety system of claim 17, wherein the first planar surface is angled relative to the second planar surface.

19. The continuous safety system of claim 1, wherein the junction box is configured to permit the safety mechanism to change direction relative to the track assembly such that the safety mechanism moves in the first direction before entering the junction box and moves in the second direction angled relative to the first direction after leaving the junction box.

20. The continuous safety system of claim 19, wherein the first direction is perpendicular to the second direction.

* * * * *